US005770265A

United States Patent [19]

Pfaender et al.

[11] Patent Number: 5,770,265

[45] Date of Patent: Jun. 23, 1998

[54] ENVIRONMENTALLY FRIENDLY TREATMENTS TO EXTEND THE FUNCTIONAL LIFE OF WOOD STRUCTURES AND NOVEL TREATED WOOD STRUCTURES

[75] Inventors: Frederic K. Pfaender, Chapel Hill, N.C.; Cloide C. Branning, Hilton Head, S.C.

[73] Assignees: Triangle Laboratories, Inc., Durham; University of North Carolina, Chapel Hill, Chapel Hill, both of N.C.

[21] Appl. No.: 896,117

[22] Filed: Jul. 17, 1997

Related U.S. Application Data

[63] Continuation of Ser. No. 534,224, Sep. 26, 1995, abandoned.

[51] Int. Cl.[6] ..... B05D 7/06

[52] U.S. Cl. ..... 427/325; 427/440; 106/15.05; 106/18.34

[58] Field of Search ..... 427/297, 298, 427/300, 325, 351, 440, 441; 428/533, 537.1, 541, 907; 106/15.05, 18.34; 264/135

[56] References Cited

U.S. PATENT DOCUMENTS

| | | |
|---|---|---|
| 655,459 | 8/1900 | Schenkel . |
| 751,981 | 2/1904 | Gordon . |
| 1,297,491 | 3/1919 | Powell . |
| 1,312,634 | 8/1919 | Kruse . |

(List continued on next page.)

FOREIGN PATENT DOCUMENTS

| | | | |
|---|---|---|---|
| 202430 | 8/1920 | Canada | 427/298 |
| 1170003 | 11/1969 | Canada . | |
| 86103583 | 5/1987 | China . | |
| 62-249707 | 10/1987 | Japan . | |
| 62-49707 | 10/1987 | Japan . | |
| 63-199603 | 8/1988 | Japan . | |
| 5096514 | 4/1993 | Japan . | |
| 7702660 | 9/1978 | Netherlands . | |
| 99648 | 6/1976 | Poland . | |
| 99648 | 11/1978 | Poland . | |
| 158853 | 10/1992 | Poland . | |
| 1750558 | 7/1992 | U.S.S.R. . | |
| 2095113 | 9/1982 | United Kingdom . | |

OTHER PUBLICATIONS

Dieck, A., Telma, vol. 17, pp. 295–297, Dec. 1987.
Schmidt, L. et al, MEDD. SVEN. Traesky DD SIN ST, No. 117E, Paper No. 4, 1976.
Babinski, L, Gaz. Cukron, 103(1), pp. 7–9, 1995.
Dieck, Telma (Hannover) (1987), 17, 295–7.
Schmidt et al, Medd. Sven. Traeskydd Sinst. (1976), 117E, Paper No. 4, 27 pp.
Hennengsson et al, Medd. Sven. Traeskyddsinst. (1976), 117E, Paper No. 1, 25 pp.

*Primary Examiner*—Erma Cameron
*Attorney, Agent, or Firm*—Charles W. Calkins; Kilpatrick Stockton LLP

[57] ABSTRACT

A method to extend the functional life of wood structures by applying fundamental principles of biology and chemistry to control the activity of wood decay organisms while minimizing the use of environmentally hazardous chemicals. The method comprises applying a microbial treating solution to a portion of the wood structure subject to decay from microbial organisms; and covering the treated portion of the wood structure with a substantially insect impenetrable material. The method of the present invention is particularly advantageous for treating wood supporting structures including, but not limited to: telephone poles, utility poles, pilings, foundations and other building supports and the like. Also disclosed are novel wood structures.

30 Claims, 1 Drawing Sheet

U.S. PATENT DOCUMENTS

| | | | |
|---|---|---|---|
| 1,313,437 | 8/1919 | Weimar . | |
| 1,527,330 | 2/1925 | Rice . | |
| 1,699,635 | 12/1929 | Smith . | |
| 1,732,379 | 10/1929 | Rice . | |
| 1,785,571 | 12/1930 | Allen . | |
| 1,877,855 | 9/1932 | Hagedorn et al. . | |
| 1,905,327 | 4/1933 | Zumwalt . | |
| 2,216,775 | 10/1940 | Helson . | |
| 2,875,020 | 2/1959 | Ring | 21/7 |
| 3,409,388 | 11/1968 | Nelson | 21/7 |
| 3,467,490 | 9/1969 | Sommer . | |
| 3,839,073 | 10/1974 | Hill | 117/57 |
| 4,174,412 | 11/1979 | Tyrer et al. . | |
| 4,325,993 | 4/1982 | Schroder | 427/315 |
| 4,466,998 | 8/1984 | McIntyre et al. | 427/297 |
| 4,656,060 | 4/1987 | Krzyzewski | 427/397 |
| 4,731,267 | 3/1988 | Makus et al. . | |
| 4,783,221 | 11/1988 | Grove | 106/18.22 |
| 5,468,284 | 11/1995 | Sturm | 106/2 |

ENVIRONMENTALLY FRIENDLY TREATMENTS TO EXTEND THE FUNCTIONAL LIFE OF WOOD STRUCTURES AND NOVEL TREATED WOOD STRUCTURES

This is a continuation of application Ser. No. 08/534,224 filed on Sep. 26, 1995, now abandoned.

FIELD OF THE INVENTION

The present invention relates to novel, degradation resistance, wood structures and a method for treating wood structures to minimize their degradation.

Background

Wood is one of the most utilized materials of human society. However, like any material, wood is susceptible to degradation. This degradation, wood decay, is believed to result primarily by physical weathering and the biological action of bacteria, fungi and insects.

Current technology for the preservation of wood and wood products relies primarily on treating the wood with chemicals which inhibit microbial and insect activity, most commonly creosote and pentachlorophenol and more recently, the use of Copper-Chromium-Arsenate (CCA). Unfortunately, the use of such chemicals and metals also represents an exposure risk to humans and the environment. As such, the use of many of these chemicals has come under government regulation. The recalcitrance of creosote and pentachlorophenol and the transportability of the metals make the widespread use of treated wood in the environment a potentially damaging environmental legacy.

Further, current wood treatment technologies do not completely prevent wood decay, but only delay it. In most cases, treated wood will require periodic re-treatment, with its inherent chemical exposure risks, to maintain effectiveness.

Summary of the Invention

The present invention provides a method to extend the functional life of wood structures by altering the environment of wood decay organisms while minimizing the use of environmentally hazardous chemicals. The method of the present invention advantageously provides an economical means for extending the life of wood structures placed into service, and/or currently in service, while significantly minimizing the environmental risks and workplace risks posed by the current treatment technology, both in initial treatment and reapplication.

According to the method of the present invention degradation of wood structures is retarded through the use of a physical barrier and a microbial treating solution, to affect the nature of the microbes in, on and surrounding the wood structure. As explained in more detail below, the microbial treating solution affects the environment of the microorganisms responsible for wood decay to minimize decay.

The method of the present invention is particularly advantageous for treating wood supporting structures including, but not limited to: telephone poles, utility poles, pilings, foundations and other building supports and the like. The method may be utilized to further treat wood structures, such as telephone poles, utility poles and the like, which have already been treated with creosote, pentachlorophenol and/or CCA.

The present invention also provides new wood structures, including the wood supporting structures listed above, with increased resistance to degradation.

An advantage of the method of the present invention is that the method minimizes the use of environmentally hazardous chemicals, and the need to retreat wood structures with environmentally hazardous chemicals.

Another advantage of the method of the present invention is that the method is simple and economical.

A further advantage of the method of the present invention is that the method may be performed at a worksite, prior to placement of the wood structure.

An advantage of the wood structures of the present invention is that the wood structures have increased degradation resistant.

Further details and advantages of the method and wood structures of the present invention will become apparent from the following more detailed descriptions.

DETAILED DESCRIPTION OF THE INVENTION

Figure 1:
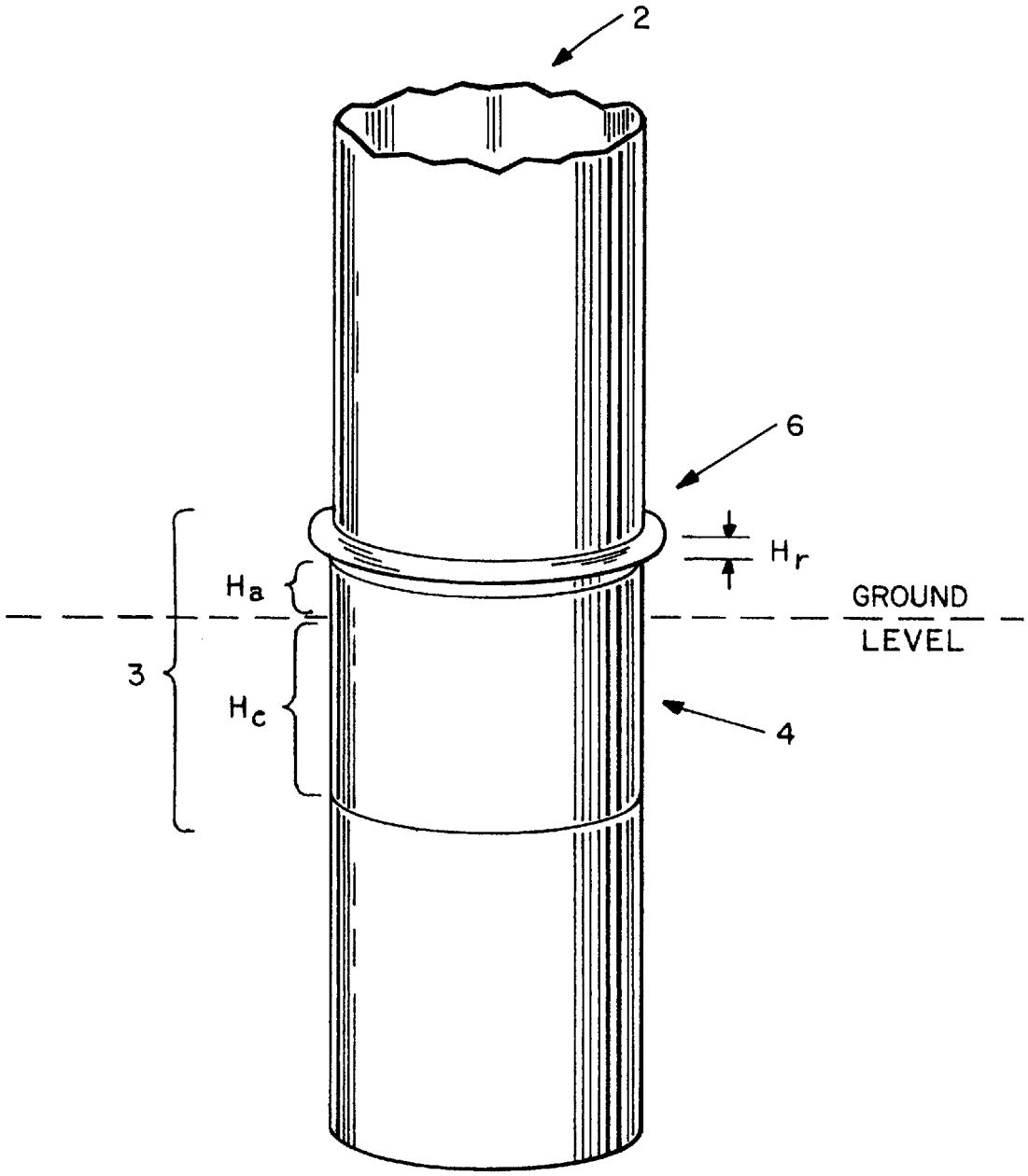
FIG. 1 depicts a wood structure (utility pole) of the present invention having been treated according to the method of the present invention.

According to the present invention, a method for treating wood structures comprises:

applying a microbial treating solution to a portion of the wood structure subject to decay from microbial organisms; and covering a portion of the wood structure subject to decay from insects with a substantially insect impenetrable material;

wherein the covered portion comprises at least a portion of the treated portion. Preferably the method for treating wood structures of the present invention further comprises applying additional microbial treating solution to the treated and/or covered portion of the wood structure, and/or the ground surrounding the wood structure, at time intervals sufficient to maintain an altered microbial community in the wood structure. The portion of the wood structure, and/or the wood structure, treated according to the method of the present invention may comprise virgin (untreated) wood, or may comprise wood treated with creosote or another chemical treatment. For example, the method of the present invention is particularly advantageous in treating utility poles which have already been treated with creosote, pentachlorophenol and/or CCA.

For wood structures placed in the ground, the portion of the wood structure subject to decay from microbial organisms includes a portion of the wood structure located where oxygen in present underground to approximately 2 feet above the ground. Similarly, the portion of the wood structure subject to decay from insect includes a portion of the wood structure located where oxygen in present underground to approximately 2 feet above the ground. Generally, for wood structures placed in the ground, the portion of the wood structure treated by the method of the present invention will be a portion extending from approximately 4 feet underground to 2 feet above the ground, preferably from 3 feet underground to 1 foot above the ground, similar portions of the wood structure will generally be covered by the substantially insect impenetrable material according to the method of the present invention.

Suitable substantially insect impenetrable materials include plastics, including polyethylene, polypropylene and the like. As understood to those of ordinary skill in the art insects may eventually penetrate any material, particularly where the material is located in an outdoor environment and therefore susceptible to puncture and or other damage. Thus, the present invention should not be construed to require that the substantially insect impenetrable material remain impenetrable over its entire life, however preferably it will. A preferred substantially insect impenetrable material is a sheet of plastic material is utilized and wrapped around the wood structure and sealed/shrink fitted by the application of heat.

In addition to providing an insect barrier, the substantially insect impenetrable material will assist in maintaining an altered environment for microbes within, on the surface of, adjacent to the surface of, and in the ground surrounding the wood structure. A further benefit is that the substantially insect impenetrable material will help to prevent seepage of any environmentally hazardous chemicals, the wood structure may have been treated with, into the environment.

The combination of the microbial treating solution, and the substantially insect impenetrable material, will generally alter the environment for insects and microbes, within, on the surface of, adjacent to the surface of, and in the ground surrounding the wood structure. This environment will be further altered by, and constantly changing due to, the effects of precipitation, humidity, temperature and the like, from the outside environment, on the wood structure. For example, the altered environment for insects and microbes will vary from an aerobic environment to an anaerobic environment, a wet to dry environment, a nutrient rich to a nutrient poor environment, etc. While not wishing to be bound by any theory, it is believed that the altering environmental conditions result in an altered microbial community (a microbial community with an altered metabolism) which will not be as active in degrading the wood structure.

In order to maintain an altered microbial community, and altered environmental conditions for insects and microbes, additional microbial treating solution may be applied to the wood structure and/or the ground surrounding the wood structure. Additional microbial treating solution may be applied to the wood structure by injecting the solution into or adjacent to the wood surface, preferably at least in part underneath the substantially insect impenetrable sheet. Preferably, additional microbial treating solution is applied through the use of a controlled release reservoir positioned above the substantially insect impenetrable on the wood structure. The reservoir may be filled with microbial treating solution which upon release will travel down the wood structure, due to gravity, and seep into the wood surface and into the area adjacent to the wood surface, underneath and on top of the substantially insect impenetrable material, and into the ground surrounding the wood surface. The reservoir may be constructed from a plastic, including but not limited to, polyethylene or polypropylene, and includes means for storing microbial treating solution and means for releasing the microbial treating solution at controlled intervals. The means for storing microbial treating solution include, but are not limited to, a reservoir, and/or vascular space in the interior portion of the reservoir. The means for releasing the microbial treating solution include small perforations or holes in the reservoir which will open under certain temperature or humidity conditions to release microbial treating solution from the storage space.

Suitable microbial treating solutions include those which will alter the environment for microbes in, on and surrounding the wood structure, and/or alter the metabolism, and/or otherwise render ineffective, microbes and bacteria which degrade wood in nature.

Wood comprises interlocked layers of cellulose and lignin. The decomposition of lignin in nature is generally understood to occur almost exclusively through the agency of fungi called Basidiomycetes and bacteria. As each layer of lignin is compromised, more of the readily degraded cellulose becomes available. It is believed the action of these fungi in concert with bacteria, which rapidly degrade cellulose, which allows for the degradation of wood in nature. Insects, such as termites can do considerable damage, but even they rely on bacteria to ultimately degrade the cellulose.

In particular, the preferred microbial treating solution comprises one or more of the following: a readily available carbon source solution, a lysis agent/surfactant solution, a osmotic pressure altering solution or mixtures thereof. These solutions may be used separately, or in concert, to control the activity of wood decay organisms immediately adjacent to the wood structure. As set forth above, regardless of which treatments are utilized the wood structure will also be wrapped in a sheet of substantially insect impenetrable material such as polyethylene. A reservoir with additional treatment solutions may also be utilized. In addition to serving as a barrier to insect penetration of the wood, the substantially insect impenetrable material will also help to isolate the microbial community immediately adjacent to the pole so that community can be more readily manipulated by the microbial treating solution(s). As explained above, the reservoir will be designed to release treatment solution gradually over time and will thereby help to reduce the need for subsequent re-treatment of the poles, preferably to the point that re-filling of the reservoir will only be required approximately every three years.

One suitable microbial treating solution comprises a readily available carbon source. In addition to their cooperation in the degradation of wood, bacteria and fungi are in competition for available resources in the area adjacent to the surface of the wood. Competition for available resources is a fundamental tenet of biology and is visible on all levels of life. To utilize this competition to control the activity of wood decay organisms, a readily available carbon source for bacteria and fungi is applied to the wood structure. Readily available carbon sources include solutions comprising 10 to 80%, by weight, preferably 40 to 60%, by weight, a carbon source, including, but not limited to, molasses, corn syrup, fruit sugars, food processing wastes, other sugar solutions and/or mixtures thereof, in water. Molasses is a preferred carbon source because molasses also includes sulfur which as explained below provides additional advantages.

The competition for a readily available carbon source should tend to favor the bacteria in the system over the fungi because the bacteria are more readily adaptable and will consume the carbon source at a rate approaching the maximum possible rate. The limiting factor in the degradation of molasses will, in fact, be another limited resource for which bacteria compete with fungi, namely oxygen. This will create anaerobic (defined as extremely depleted oxygen) conditions at, and adjacent to the wood surface, and lead to the rise of organisms which are adapted to life without oxygen. Anaerobic organisms make their energy through the reduction of available compounds and in the absence of oxygen and nitrate the reduction of sulfur compounds is favored. These processes produce far less energy than aerobic processes and as such are much slower. Further, there are no known pathways for the anaerobic biodegradation of lignin. Thus, the anaerobic community should be either greatly slowed or completely prevented from the degradation of the wood present. When the microbial treating solution comprises molasses as a readily available carbon source, the reduction of the sulfur in the sulfured molasses should produce hydrogen sulfide ($H_2S$). $H_2S$ will further inhibit insect activity and in addition make the molasses solution less attractive to larger animals who might seek out the molasses initially.

Another suitable microbial treating solution, which may be utilized in conjunction with other microbial treating solutions comprises a lysis agent and a surfactant, or a lysis agent/surfactant. A preferred lysis agent/surfactant is sodium dodecyl sulfate (SDS), preferably in a 1 to 20%, by weight, solution in water. The application of a dilute (0.5 to 2.0%, by weight, in water) SDS to the wood surface is intended to have at least two effects on microbial organisms. First, SDS is capable of lysing the cell membranes of many bacterial species thereby causing their death. Second, SDS is a surfactant and thus structurally has both lipophilic and hydrophilic moieties. As such, through the formation of micelles, SDS can increase the effective solubility of any creosote or pentachlorophenol present in the wood structure. This increase in the effective solubility theoretically increases the microbial reducing activity of the creosote or pentachlorophenol, without adding new amounts of these compounds to the system.

Another suitable microbial treating solution is one which will alter the osmotic pressure conditions at the wood surface, and/or immediately adjacent to the wood surface. Suitable osmotic pressure altering solutions include, but are not limited to concentrated salt solutions, sugar solutions, other ion rich solutions and the like. For example, the application of a relatively concentrated salt (NaCl) solution to the wood surface alter the osmotic conditions immediately adjacent to the pole. This additional environmental pressure should affect the microbial community at, and adjacent to, the wood surface. The effects are relevant because of the cooperation required between the more highly evolved, but less adaptable fungi and the more rapidly adaptable bacteria. The salty conditions should therefore favor bacteria which are not inhibited by the salt to the exclusion of fungi both initially, and subsequently, because while there are known to be halophilic (salt-loving) species of bacteria, there are no currently known species of halophilic fungi. High concentrations of salt also can be toxic to and therefore deter insects, should they be able to penetrate the substantially insect impenetrable barrier. Salt should also accumulate adjacent to the pole over time if it is prevented from contact with rainwater (e.g. through the use of a plastic substantially insect impenetrable material) which will maximize its effectiveness as the greater the concentration of salt the better its effect.

A novel wood structure of the present invention comprises a wood structure which has been treated according to the method of the present invention. More particularly according to the present invention, a wood structure comprises:

- a wooden member;
- a microbial treating solution in contact with a portion of the surface of the wooden member; and
- a substantially insect impenetrable material in contact with the microbial treating solution and thereby in contact with the portion of the surface of the wooden member.

Preferably the wood structure further comprises: a reservoir, with additional microbial treating solution contained within, positioned adjacent to the portion of the surface contacted with the microbial treating solution and including means for dispensing the additional microbial treating solution onto the portion of the surface, and into the area between the portion of the surface and the substantially insect impenetrable material.

As set forth above, wood structures of the present invention include, but are not limited to, wood supporting structures such as telephone poles, utility poles, pilings, foundations and other building supports and the like. The wood structure of the present invention may comprise "virgin" (untreated) wood or wood that has been treated with creosote, pentachlorophenol, CCA, and/or other treating agents.

Suitable microbial treating solutions, substantially insect impenetrable materials and reservoirs for use in the wood structure of the present invention, and details relating to the assembly and use of the wood structure of the present invention are set forth above with respect to the method of the present invention, and in the following paragraphs.

FIG. 1 depicts a utility pole treated according to the method of the present invention, and which is a wood structure of the present invention. Referring to FIG. 1, a utility pole 2 includes a substantially insect impenetrable material 4 surrounding a portion 3, of the surface of the utility pole near ground level and a reservoir 6, surrounding pole 2, and located at, or adjacent to surface portion 3.

$H_a$ is the height (depth) of material 4 above ground level and $H_u$ is the height (depth) of material 4 beneath ground level. As set forth above, $H_u$ is preferably equal to the soil depth where oxygen is present. Generally, for most soils, $H_u$ will be 0.5 foot to 4 feet, preferably 1 to 3 feet, more preferably approximately 3 feet. $H_a$ is preferably equal to the distance above ground (height) where microbial and insect populations are substantial. Generally, $H_a$ will be 0.25 foot to 2 feet, preferably 0.5 foot to 1.5 feet, more preferably approximately 1 foot.

$H_r$ is the height of reservoir 6 above material 4. $H_r$ is preferably a distance which will permit microbial solution to contact the portion 3 of the surface of the utility pole near ground level, and to travel into the space adjacent to the wood surface at portion 3 and underneath material 4. Generally, $H_r$ will be 0.0 inches to 6 inches, preferably 0.0 inches to 3 inches.

Treated utility pole 2 may be assembled prior to placement in the ground or after placement in the ground prior to back-filling the hole. For assembly, a microbial treating solution is applied to surface portion 3 of utility pole 2. Then the substantially insect impenetrable material 4, is wrapped around pole 2, over at least a portion of the microbial treating solution. Reservoir 6, is then affixed to pole 2 utilizing adhesives, and/or fasteners such as nails, screws, or the like. Reservoir 6 may be filled with microbial treating solution prior to affixing the reservoir to the pole, or after affixing the reservoir to the pole. Utility pole 2, may then be placed upright in a hole in the ground and utilized.

As will be understood to those of ordinary skill in the art, the portion 3, of the pole's surface to be treated may be determined by knowing the depth of the hole in which the pole will be placed and which end of the pole will be placed into the ground. The portion 3 may then be easily determined by determining the portion of the pole which will end up at ground level. Additionally, the portion of the pole treated with the microbial treating solution and the portion of the pole covered with the substantially insect impenetrable barrier may be the same or different but will generally overlap at least in part.

It will thus be seen that the advantages set forth, among those made apparent from the preceding description, are efficiently obtained by the method and wooden structure of the present invention. Since certain changes may be made in carrying out the above embodiments of the method and wooden structure system of the present invention, and in their manner of construction, without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A method for treating a wood structure comprising:

applying a microbial treating solution to a portion of the wood structure subject to decay from microbial organisms, wherein said microbial treating solution comprises a solution which creates an altered environment in soil for microbial organisms and bacteria which degrade wood to thereby reduce the degradation of the wood structure caused by said organisms and bacteria and covering a portion of the wood structure subject to decay from insects with a substantially insect impenetrable material to form a physical substantially insect impenetrable barrier and assist in maintaining the altered environment; wherein the covered portion comprises at least a portion of the treated portion.

2. The method of claim 1 further comprising:

applying additional microbial treating solution to the wood structure at time intervals sufficient to maintain the altered environment for the microbial organisms and bacteria.

3. The method of claim 1 wherein the microbial treating solution comprises a solution comprising a readily available carbon source; a solution comprising a lysis agent and a surfactant; a solution comprising an osmotic pressure affecting agent or mixtures thereof.

4. The method of claim 1 wherein the microbial treating solution comprises:

a readily available carbon source.

5. A method for treating a wood structure comprising:

applying a microbial treating solution to a portion of the wood structure subject to decay from microbial organisms, wherein said microbial treating solution comprises a solution which creates an altered environment for microbial organisms and bacteria which degrade wood to thereby reduce the degradation of the wood structure caused by said organisms and bacteria and covering a portion of the wood structure subject to decay from insects with a substantially insect impenetrable material to form a physical substantially insect impenetrable barrier and assist in maintaining the altered environment; wherein the covered portion comprises at least a portion of the treated portion, wherein the microbial treating solution comprises a readily available carbon source, and wherein the readily available carbon source is molasses.

6. The method of claim 1 wherein the substantially insect impenetrable material comprises a plastic.

7. A The method of claim 4 wherein the substantially insect impenetrable material comprises a plastic.

8. The method of claim 7 wherein the plastic is selected from the group consisting of:

polyethylene and polypropylene.

9. The method of claim 1 wherein the microbial treating solution comprises:

a lysis agent and a surfactant.

10. The method of claim 9 wherein sodium dodecyl sulfate is the lysis agent and the surfactant.

11. The method of claim 1 wherein the microbial treating solution comprises a salt solution.

12. The method of claim 4 wherein the readily available carbon source is sugar.

13. A method for treating a wood structure comprising:

applying a microbial treating solution to a portion of the wood structure subject to decay from microbial organisms, said microbial treating solution comprising a readily available carbon source; and covering a portion of the wood structure subject to decay from insects with a substantially insect impenetrable material;

wherein the covered portion comprises at least a portion of the treated portion and said readily available carbon source is molasses.

14. A method for delaying decay of a wood structure placed into the environment comprising:

applying a microbial treating solution to the ground surrounding the wood structure wherein said microbial treating solution comprises a solution which creates an altered environment for microbial organisms and bacteria which degrade wood to thereby reduce the degradation of the wood structure caused by said organisms and bacteria.

15. The method of claim 14 further comprising:

re-applying additional microbial treating solution to the ground surrounding the wood structure at time intervals sufficient to maintain an altered environment for microbial organisms and bacteria.

16. The method of claim 14 wherein the microbial treating solution comprises: a solution comprising a carbon source readily utilizable by microbial organisms; a solution comprising a lysis agent and a surfactant; a solution comprising an osmotic pressure affecting agent; or mixtures thereof.

17. The method of claim 14 wherein the microbial treating solution comprises:

a readily available carbon source.

18. A method for delaying decay of a wood structure placed into an environment comprising:

applying a microbial treating solution to ground surrounding the wood structure wherein said microbial treating solution comprises a solution which creates an altered environment for microbial organisms and bacteria which degrade wood to thereby reduce the degradation of the wood structure caused by said organisms and bacteria, wherein the microbial treating solution comprises a readily available carbon source, and wherein the readily available carbon source is molasses.

19. The method of claim 17 wherein the readily available carbon source is sugar.

20. The method of claim 13 wherein said substantially insect impermeable material is a plastic.

21. The method of claim 20 wherein the plastic comprises: polyethylene; polypropylene; or mixtures thereof.

22. A method for delaying decay of a wood structure placed into the environment comprising:

applying a microbial treating solution to a portion of the wood structure subject to decay from microbial organisms, and to the ground surrounding the wood structure, wherein said microbial treating solution comprises a solution which creates an altered environment for microbial organisms and bacteria which degrade wood to thereby reduce the degradation of the wood structure caused by said organisms and bacteria; and covering a portion of the wood structure subject to decay from insects with a substantially insect impenetrable material to form a physical barrier and assist in maintaining the altered environment.

23. The method of claim 22 further comprising:

applying additional microbial treating solution to the ground surrounding the wood structure at time intervals sufficient to maintain the altered environment.

24. The method of claim 22 wherein the microbial treating solution comprises: a solution comprising a readily available carbon source; a solution comprising a lysis agent and a surfactant; a solution comprising an osmotic pressure affecting agent; or mixtures thereof.

25. The method of claim 24 wherein the microbial treating solution comprises:

a readily available carbon source.

26. A method for delaying decay of a wood structure placed into an environment comprising:

applying a microbial treating solution to a portion of the wood structure subject to decay from microbial organisms, and to ground surrounding the wood structure wherein said microbial treating solution comprises a solution which creates an altered environment for microbial organisms and bacteria which degrade wood to thereby reduce the degradation of the wood structure caused by said organisms and bacteria; and covering a portion of the wood structure subject to decay from insects with a substantially insect impenetrable material to form a physical barrier and assist in maintaining the altered environment, wherein the microbial treating solution comprises a readily available carbon source and wherein the readily available carbon source is molasses.

27. The method of claim 22 wherein the substantially insect impenetrable material comprises a plastic.

28. The method of claim 27 wherein the plastic comprises: polyethylene; polypropylene; or mixtures thereof.

29. A method for delaying decay of a wood structure placed into the environment comprising:

applying a microbial treating solution to ground surrounding the wood structure, wherein said microbial treating solution comprises a solution which creates an altered environment for microbial organisms and bacteria which degrade wood to thereby reduce the degradation of the wood structure caused by said organisms and bacteria and wherein the microbial treating solution comprises: a solution comprising a sugar readily utilizable by microbial organisms; a solution comprising a lysis agent and a surfactant; a solution compromising an osmotic pressure affecting agent; or mixtures thereof.

30. The method of claim 29 further comprising:

re-applying additional microbial treating solution to the ground surrounding the wood structure at time intervals sufficient to maintain an altered environment for microbial organisms and bacteria.

* * * * *